United States Patent [19]

Bell et al.

[11] Patent Number: 4,550,867

[45] Date of Patent: Nov. 5, 1985

[54] SHROUD TUBE MANIPULATING AND SUPPORTING APPARATUS

[75] Inventors: John R. Bell, Edwardsville; Robert E. Scoville; Joade Whitt, both of Granite City, all of Ill.

[73] Assignee: National Steel Corporation, Pittsburgh, Pa.

[21] Appl. No.: 541,931

[22] Filed: Oct. 14, 1983

[51] Int. Cl.[4] ..... B22D 41/08

[52] U.S. Cl. ..... 222/607; 222/533; 164/437; 414/744 A

[58] Field of Search ..... 222/600, 607, 606, 594, 222/597, 598, 599, 504, 533, 556; 164/337, 437; 901/15; 414/729, 744 R, 744 A; 266/226, 236

[56] References Cited

U.S. PATENT DOCUMENTS

| | | | |
|---|---|---|---|
| 3,884,400 | 5/1975 | Tuschak et al. | 222/533 |
| 3,937,372 | 2/1976 | Bode, Jr. | 222/600 |
| 4,079,869 | 3/1978 | Meier et al. | 222/600 |
| 4,131,220 | 12/1978 | Bode, Jr. et al. | 222/607 |
| 4,222,505 | 9/1980 | Daussan et al. | 222/600 |
| 4,262,827 | 4/1981 | DeMasi | 222/607 |
| 4,270,595 | 6/1981 | Coward | 164/415 |
| 4,316,561 | 2/1982 | Grosko | 222/606 |
| 4,359,625 | 11/1982 | Okada et al. | 219/300 |
| 4,381,102 | 4/1983 | King | 266/44 |
| 4,402,437 | 9/1983 | Fortner et al. | 222/607 |

FOREIGN PATENT DOCUMENTS

| | | | |
|---|---|---|---|
| 2053148 | 2/1981 | United Kingdom | 901/15 |

*Primary Examiner*—Joseph J. Rolla
*Assistant Examiner*—Louise S. Heim
*Attorney, Agent, or Firm*—O'Neil & Bean

[57] ABSTRACT

An apparatus for positioning and supporting a shroud tube in a metal teeming operation includes a boom assembly having one end pivotally mounted on a rigid structure for movement about a vertical axis and is articulated intermediate its ends to permit universal movement of its other end in a horizontal plane, and an elongated shroud tube support arm is mounted intermediate its ends on the universally movable end of the boom assembly for movement therewith, for limited pivotal movement about a horizontal axis, and for limited rotational movement about its longitudinal axis. A bifurcated yoke at one end of the support arm engages and supports a shroud tube, and power drive is provided at the other end of the support arm for rotating the support arm about its longitudinal axis. The power drive is operably associated with the boom shroud tube support arm for pivoting the support arm about said horizontal axis, and controls are provided for controlling operation of the power drive to rotate the support arm about the horizontal axis to raise and lower a shroud tube supported on the yoke with the controls being manually operable to selectively raise and lower the shroud tube for positioning relative to the bottom opening in a teeming vessel.

5 Claims, 6 Drawing Figures

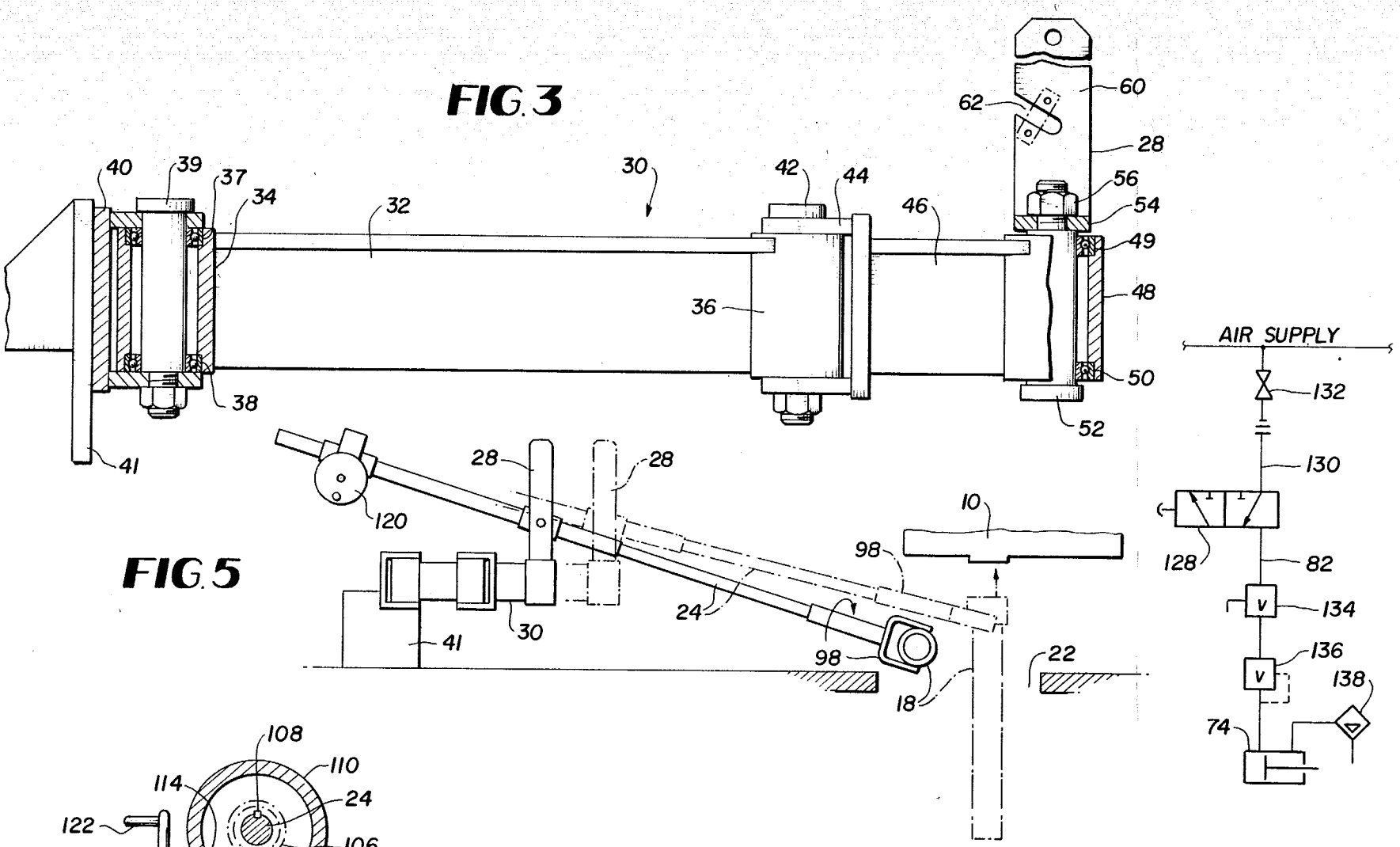
FIG. 3
FIG. 5
FIG. 6
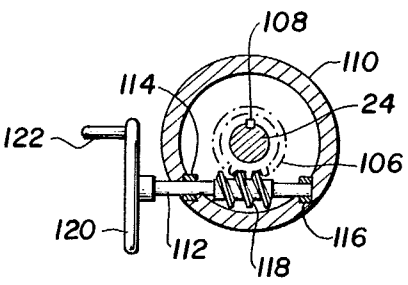
FIG. 4

SHROUD TUBE MANIPULATING AND SUPPORTING APPARATUS

This invention relates to apparatus for supporting and manipulating a shroud tube of the type employed to enclose a stream of molten metal flowing from the bottom pour discharge nozzle of a teeming vessel or ladle into a receiving vessel such as a casting tundish.

It is known to use a tubular shaped pouring shroud surrounding a stream of hot metal flowing from a ladle to protect the metal against oxidation as a result of contact with the atmosphere and to enable more precise control of the stream flowing from the outlet nozzle to the receiving vessel. For example, in the continuous casting of killed steels, it is desirable to protect the metal from contact with ambient air to prevent reoxidation of the metal. To this end, the tundish conventionally is provided with a cover having a relatively small access opening through which the molten metal is teemed from the ladle. The ladle is conventionally supported in relative close proximity to the tundish cover, leaving a limited space for manipulation of the shroud tube which, during use, extends from the slide gate valve of the ladle into the tundish through the cover opening.

Numerous devices have been developed for moving a shroud tube, or pouring tube, from a retracted or storage position spaced from the vessels to a use position having its upper end supported against the outlet nozzle through which the hot metal flows and its lower end projecting into the receiving tundish. Flow from the bottom of the ladle is controlled by a slide gate valve, with the metal stream being completely shielded from the atmosphere during the pouring operation. Difficulty has been encountered, however, in manipulating the shroud tube into the use position because of the restricted access space between the ladle and tundish and because of the necessity for the operator to work in the vicinity of the hot metal. In most installations, it is necessary to support the shroud tube in a generally horizontal or inclined attitude to move it into position between the ladle and tundish and to initially tilt the tube to insert the bottom end through the tundish cover opening then rotate it to the vertical attitude and raise it into contact with the outlet valve. Once positioned, the shroud tube may be releasably secured to support structure associated with the bottom of the ladle and the sliding gate valve, and an apparatus for manipulating and supporting a shroud tube in this manner is disclosed in U.S. Pat. No. 4,316,561.

It is also known to employ shroud tube positioning and manipulating apparatus which, during use, continuously supports the shroud tube and retains it in position in contact with the outlet nozzle. However, since the ladle may move during use, it is necessary for such devices to retain the nozzle in position with a biasing force during limited movement in both the vertical and horizontal directions. In one prior art device of this type, the biasing force has been supplied by a counterbalance weight on the shroud tube manipulating arm and by a pivotal mounting for the shroud tube support arm which is itself supported for movement in a horizontal plane by a pivoted, articulated boom structure. Use of a counterbalance weight, however, necessarily made manipulation of the nozzle more difficult by the operator during positioning of the shroud tube and the present invention is directed to an improved shroud tube handling apparatus of this general type. It is therefore the primary purpose of the invention to provide such an improved manually controlled shroud tube handling and supporting apparatus.

Another object of the invention is to provide an improved manually controlled shroud tube handling apparatus having an operator controlled power assist for balancing the handling apparatus and supporting the shroud tube during manipulation and for firmly but yieldingly urging the shroud tube into position in contact with the teeming vessel outlet during use.

Another object of the invention is to provide such an improved shroud tube handling and supporting apparatus which will support the shroud tube in operative association with the pouring vessel during teeming of metal through the tube, with the shroud tube being movable both in a vertical and horizontal plane to accommodate any movement of the teeming vessel during operation.

In the attainment of the foregoing and other objects and advantages of the invention, an important feature resides in providing a shroud tube handling and supporting apparatus including an elongated tube positioning arm having one end telescopingly received in and journaled for rotation about its longitudinal axis by an elongated sleeve which, in turn, is mounted for pivotal movement about a horizontal axis on the free end of a support boom assembly. The support boom assembly comprises a first structural beam having a free end supporting the elongated sleeve and having its other end mounted for free pivotal movement about a first vertical axis on one end of a second support beam which, in turn, has its other end pivotally mounted for movement about a second vertical axis by a rigid frame structure. The two beams thus form an articulated boom which supports the sleeve and support arm for universal movement in a horizontal plane while the support arm is pivotally mounted for movement in a vertical plane and for rotational movement about its longitudinal axis by the sleeve. The free end of the support arm terminates in a bifurcated yoke providing a gimbal-like support for a pair of trunnions mounted on the upper end of a shroud tube to permit limited swinging movement of a shroud tube supported on the yoke in the vertical plane of the support arm. Thus, the shroud tube can remain in a vertical attitude while the support arm is pivoted, within limits, in its vertical plane about its horizontal pivot axis.

The sleeve is provided with trunnions which are journaled in bearings carried by a mounting bracket carried on the free end of the articulated boom to permit pivot movement of the support arm in a vertical plane and a manually actuated gear drive is provided between the sleeve and support arm to permit an operator to rotate the support arm about its horizontal axis to incline a shroud tube supported in the bifurcated yoke to enable the shroud tube to be inserted between the teeming vessel and the receiving vessel and to be rotated back to permit the lower end of the shroud tube to be inserted through the opening in the receiving vessel cover. The mounting bracket is supported on the boom assembly for free pivotal movement about a vertical axis, and a fluid actuated cylinder connected between the sleeve and mounting bracket controls the pivotal movement of the support arm about its horizontal pivot axis. The operator may control actuation of the fluid cylinder to selectively pivot the arm during manipulation of the apparatus to position a shroud tube in contact with the teeming vessel, and to apply a continuous, resilient load to the arm to maintain the shroud tube in position in contact with the teeming vessel during use. Thus, an operator can easily and safely maintain accurate control of the apparatus during manipulation, to insert or remove a shroud tube while the apparatus automatically maintains the shroud tube in position during teeming.

Other features and advantages of the apparatus of the present invention will be apparent from the detailed description contained hereinbelow, taken in conjunction with the drawings, in which:

FIG. 3 is an enlarged elevation view, partially in section, showing the articulated support boom and mounting bracket;

FIG. 4 is a fragmentary sectional view taken on line 4—4 of FIG. 2;

FIG. 5 is an elevation view, partially in section, showing a shroud tube being manipulated into position between a teeming vessel and a receiving vessel; and FIG. 6 is a schematic of the control system employed in the apparatus.

Figure 1:
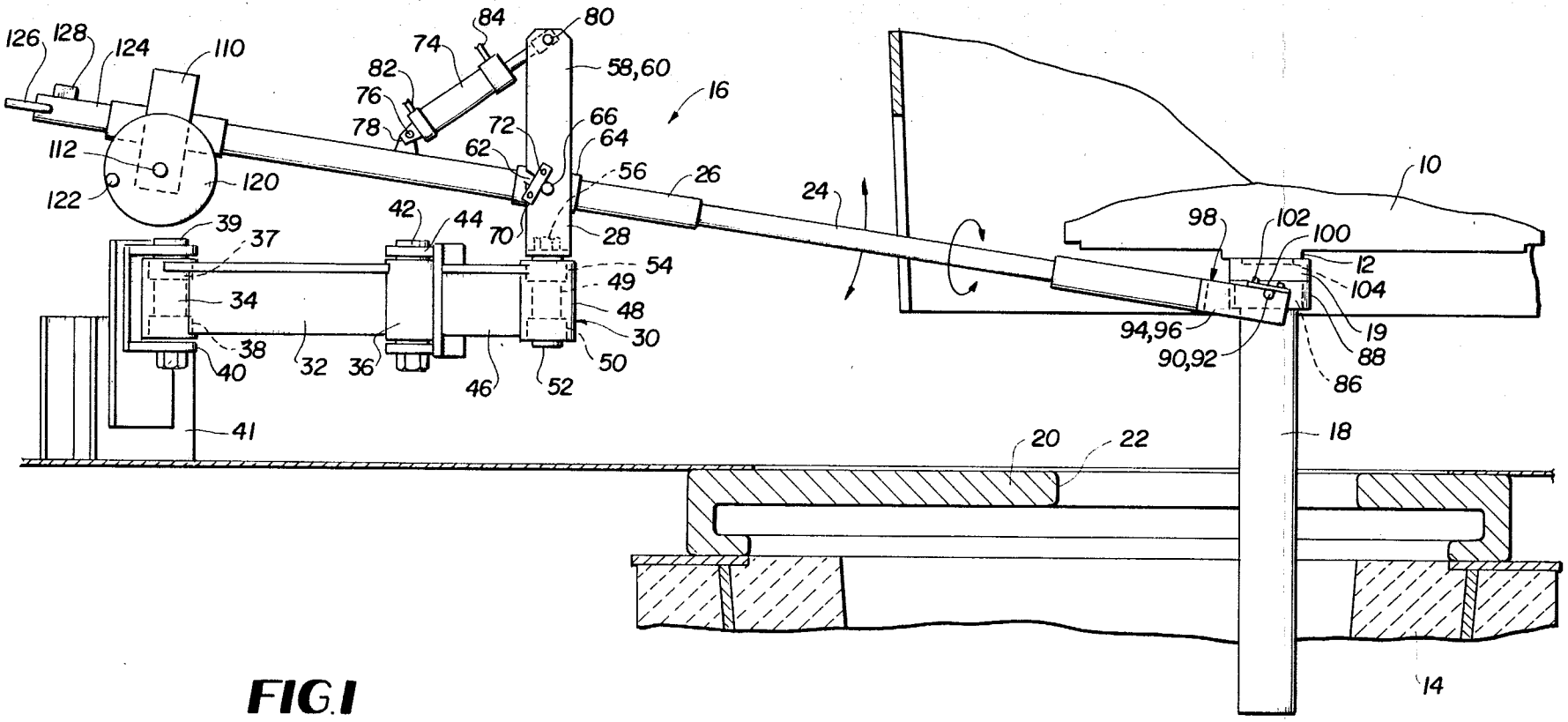
FIG. 1 is an elevation view of a molten metal teeming apparatus incorporating the shroud tube mounting and manipulating apparatus according to the present invention.
Figure 2:
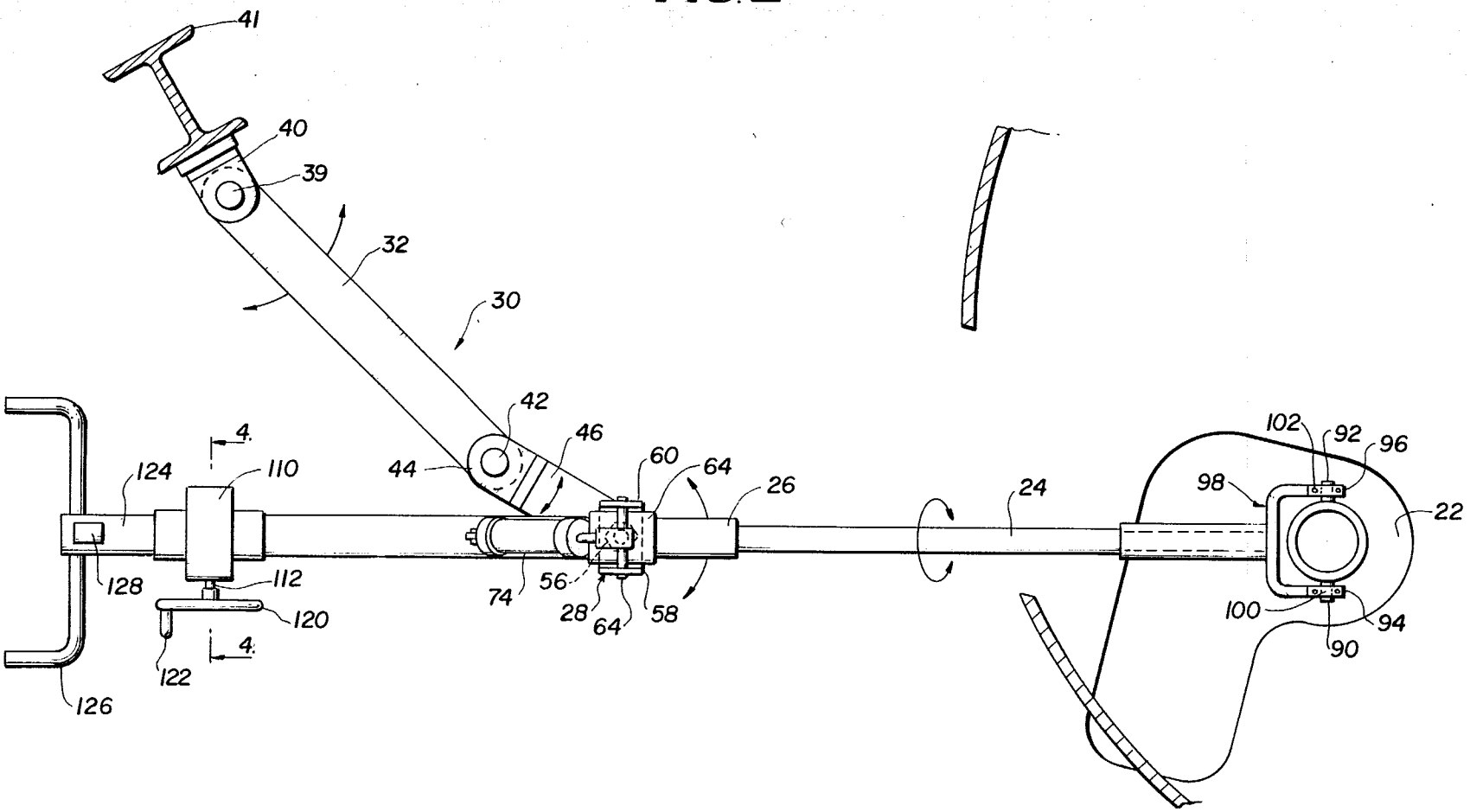
FIG. 2 is a top plan view of the shroud tube manipulating apparatus shown in FIG. 1.

Referring now to the drawings in detail, a molten metal pouring installation is illustrated as including a teeming or pouring vessel such as a ladle 10 having a bottom outlet tube or nozzle 12 through which the molten metal flows into a receiving vessel such as the tundish 14. A shroud tube supporting and manipulating apparatus, indicated generally by the reference numeral 16, is illustrated as supporting a shroud tube 18 in contact with outlet nozzle 12 to contain the stream of molten metal between the ladle and tundish. The outlet 12 may be carried on the slide gate 19 of the conventional bottom outlet gate valve used to control the flow of molten metal from a ladle or the like in a bottom pour operation.

Tundish 14 is provided with a cover 20 having an opening 22 therein for receiving the bottom end portion of the shroud tube 18. As shown in FIG. 1, tube 18 is longer than the distance between the outlet 12 and the top of the cover 20, so that the shroud tube normally projects into the tundish to a point below the level of the molten metal maintained in the tundish during the pouring operation.

The shroud tube supporting and manipulating apparatus 16 includes an elongated support arm 24 having one end telescopingly received in a sleeve assembly 26 mounted for pivotal movement about a transverse, horizontal axis by bracket 28 which, in turn, is supported for free pivotal movement about a vertical axis on the distal end of an articulated boom assembly 30. The articulated boom assembly 30 includes a first elongated beam 32 having a pair of bearing sleeves 34, 36 rigidly welded one on each of its ends, and a pair of antifriction bearings 37, 38 in sleeve 34 mount beam 32 for free pivotal movement about the vertical axis of a shaft 39 retained in a mounting bracket 40 rigidly joined to a support column 41. A second pair of antifriction bearings (not shown) in sleeve 36 support a second vertical shaft 42 retained by bracket 44 on one end of a second beam 46. A bearing sleeve 48 rigidly welded on the other end of beam 46, receives a third pair of antifriction bearings 49, 50 which support a third shaft 52 for free rotation about its vertical axis. Thus, boom assembly 30 is articulated for limited free, universal movement of the bearing 48 and shaft 52 in a horizontal plane which extends between the tundish cover 20 and the bottom of ladle outlet 12. Support column 34 and the boom assembly 30 are positioned in laterally spaced relation to the tundish and ladle, with the elongated shroud tube support arm 24 being adapted to be moved into the space between the ladle and tundish to support tube 18 in the operative or use position illustrated in FIG. 1.

Support bracket 28 comprises a base 54 rigidly mounted, as by fastener 56, on the upwardly projecting end of shaft 52, with a pair of vertically extending, laterally spaced arms 58, 60 rigidly mounted one on each end portion of base 54. A pair of downwardly and inwardly inclined slots 62 are formed one on the side edge portion of each of the arms 58, 60 in upwardly spaced relation to the base 54. An annular collar 64 on sleeve assembly 26 carries a pair of trunnions 66 which are received one in each of the slots 62 to support the sleeve 26 and support arm 24 for pivotal movement in a vertical plane about the horizontal axis of the trunnions. The trunnions are retained in the slots 62 by a bar member 70 which extends across one or both of the slots and secured to the adjacent arm surface by suitable means such as threaded fasteners 72.

A linear fluid motor 74 has its cylinder end connected, as by pin 76 and bracket 78, to sleeve 26 at a point spaced from the collar 64, and its piston end connected by pin 80 to the top portion of arms 58, 60 of bracket 28. Actuation of motor 74 is controlled by fluid such as air under pressure admitted to the piston end of the cylinder through a suitable conduit 82, and a second conduit 84 connected through a suitable filter permits ambient air to flow into the rod end of the cylinder. The location of the collar 64 and trunnions 66 are such that, when the apparatus is employed to support a shroud tube 18, the weight of the shroud tube and the portion of the support arm 24 and sleeve assembly 26 between the trunnions and sleeve is greater than the weight of the structure on the opposite side of the trunnions so that a positive fluid pressure is required through conduit 82 to maintain the sleeve in engagement with the outlet 12 of ladle 10.

The shroud tube 18 has an enlarged head portion 86 at its upper end, and a metal collar 88 surrounds the sleeve adjacent the enlarged head 86. A pair of trunnions 90, 92 project from the sleeve 88 and are adapted to be received in upwardly directed U-shaped notches formed one in the top edge portion of each of a pair of laterally spaced arms 94, 96 of a bifurcated yoke 98 rigidly mounted on the end of arm 24. Suitable retaining straps 100 and fasteners 102 are provided to releasably retain the trunnions in position on the yoke arms to permit tilting of the shroud tube 18 in the manner described more fully hereinbelow. A recess 104 in the open top end of shroud tube 18 is adapted to receive the downwardly directed outlet tube 12 of the tundish.

The end of shroud tube support arm 24 opposite the yoke 98 has a ring gear 106 fixed thereon by key 108 for rotation with the support arm about its longitudinal axis. Gear 106 is contained in a housing 110 rigidly fixed on the end of sleeve 26. A transversely extending drive shaft 112 mounted in housing 110 by bearings 114 and 116 supports a worm gear 118 which engages ring gear 106. Shaft 112 is adapted to be manually rotated by a drive wheel 120 having a crank member 122 attached to its rim in position to be readily accessible by an operator to enable manual rotation of the support arm 24 about its longitudinal axis within the support sleeve 26. To facilitate such manual rotation, suitable antifriction bearings, not shown, may be provided between the support arm 24 and the sleeve 26.

An extension 124 of sleeve 26 is mounted on and projects from gear box 110 in substantially coaxial relation with the support arm 24, and a handlebar assembly 126 rigidly mounted on the end of extension 124 provides means for grasping and manually manipulating the support apparatus. A control valve 128 is provided on extension 124 adjacent the handlebar 126 in position to be readily accessible to an operator to control the application of fluid pressure through line 82 to control actuation of fluid motor 74 to pivot sleeve 26 and support arm 24 about the horizontal axis defined by trunnions 66 to raise and lower the shroud tube.

As seen in FIG. 6, valve 128 may be connected through line 130 and shut-off valve 132 to a suitable source of air pressure, with conduit 82 connecting the valve 128 to the head end of cylinder 74. As schematically shown, valve 128 may be a three-way valve normally biased to the closed position and manually operable to supply system air pressure from line 130 to line 82 to extend the air cylinder and raise a shroud tube supported on the bifurcated yoke, or to a third position permitting air to be bled from the cylinder through lines 82 to atmosphere to lower the shroud tube. A suitable pressure relief valve 134 and a relieving type pressure regulating valve and gage 136 are connected in line 82 to control the air supply to cylinder 74 and to assure against overpressurization of the cylinder. A suitable air filter 138 may be connected to line 84 to eliminate dust and the like from being drawn into the rod end of the cylinder.

From the above description, it will be apparent that the apparatus described can be employed to support and manipulate a shroud tube both to position the tube between the ladle and tundish and to maintain the shroud tube in contact with the ladle outlet during teeming. Thus, an operator may grasp the handlebar 126 to move the yoke 98 to a shroud tube support rack, not shown, at a location spaced from the tundish and ladle by pivotting the sleeve 26 about the vertical axis of shaft 52, and by swinging the articulated boom assembly 30 as required. Air pressure is then supplied to, or bled from the cylinder 74 to permit the yoke to be engaged with the trunnions 90, 92 on the collar 88 of a shroud tube. Locking straps 100 are then secured in position to support the shroud tube on the yoke while permitting it to pivot freely about the axis of trunnions 90, 92. Application of increased air pressure to cylinder 74 will then lift the shroud tube and support it entirely on the end of the arm 24. In this position, drive wheel 112 can be manually turned to rotate arm 24 through the gear reduction mechanism described above to tilt the shroud tube sufficient to permit it to be moved between the ladle and tundish. Once the bottom end of the shroud tube is located above the opening 22 in the cover 20 of tundish 14, arm 24 can again be rotated to return the shroud tube to the vertical position, with arm 24 being moved manually about its vertical pivot and/or on the boom 30 to permit the shroud tube to be inserted into the tundish. The apparatus is then manually maneuvered to align the axis of the shroud tube 18 with the outlet 12 and air is supplied through tube 82 to apply a predetermined force, as determined by pressure regulator 136, to maintain the shroud tube in contact with the outlet of the ladle. With pressure maintained constant in cylinder 74, the shroud tube will be maintained in position and will follow any movement of the ladle in either the vertical or lateral direction, with lateral movement being accommodated by the universal action of boom assembly 30. Use of the selectively operable power control system between the support bracket and sleeve instead of the conventional counterbalance weights in the vicinity of the handlebars avoids the difficulty and hazards associated with manually manipulating a shroud tube positioning apparatus with such counterbalance weights in the vicinity of the molten metal and metal handlig apparatus. Further, the system provides extremely reliable yet sensitive control of manipulation of the shroud tube and permits safer and more rapid movement of the apparatus for changing shroud tubes as is frequently required during teeming.

While a preferred embodiment of the invention has been disclosed and described, it should be apparent that various modifications may be made without departing from the invention and it is therefore to be understood that the invention is not so limited, but rather that it is intended to include all embodiments which would be apparent to one skilled in the art and which come within the spirit and scope of the invention.

What is claimed is:

1. In an apparatus for positioning and supporting a shroud tube for use in a metal teeming operation in which molten metal is poured from a bottom opening of a teeming vessel into a receiving vessel positioned beneath the bottom opening, the apparatus including a boom assembly having one end mounted on a rigid structure for pivotal movement about a vertical axis and being articulated intermediate its end to permit universal movement of its other end in a horizontal plane, an elongated shroud tube support arm, and means mounting the support arm intermediate its ends on the universally movable end of the boom assembly for movement therewith, for limited pivotal movement about a horizontal axis, and for limited rotational movement about its longitudinal axis, a bifurcated yoke at one end of the support arm for engaging and supporting a shroud tube, and drive means at the other end of said support arm for rotating the support arm about its longitudinal axis, the improvement comprising power means operably associated with said boom assembly and said shroud tube mounting means for pivoting said support arm about said horizontal axis, control means for controlling operation of said power means to rotate said support arm about said horizontal axis to raise and lower a shroud tube supported on said yoke means, said control means being manually operable to selectively raise and lower the shroud tube for positioning relative to the bottom opening in the teeming vessel and to urge the shroud tube into engagement with the teeming vessel outlet valve during use of the shroud tube, said means mounting said support arm comprising a bracket pivotally mounted on and projecting upwardly from the universally movable end portion of said boom assembly for movement therewith and for free pivotal movement about a vertical axis, said bracket including means journaling said support arm for pivotal movement about a horizontal axis spaced above said boom, and said means mounting said support arm for rotation about its longitudinal axis comprising an elongated sleeve telescopingly receiving one end portion of said support arm, said sleeve including trunnion means engaging said bracket for supporting said sleeve and said support arm for said pivotal movement about said horizontal axis.

2. The apparatus defined in claim 1 wherein said power means comprises a fluid actuated cylinder means having one end connected to said bracket and its other end connected to said sleeve, said cylinder means being longitudinally extensible and retractable to pivot said sleeve about said trunnion means.

3. The apparatus defined in claim 1 wherein said control means comprises manually operable valve means connected to a source of fluid under pressure for selectively controlling the application of fluid pressure to said cylinder means.

4. The apparatus defined in claim 3 wherein said valve means is normally biased to a position to supply fluid under pressure to said cylinder means to continuously urge a shroud tube supported by said apparatus into engagement with the opening in a teeming vessel with a predetermined force.

5. The apparatus defined in claim 4 wherein said power means comprises a fluid actuated cylinder means having one end connected to said bracket and its other end connected to said sleeve, said cylinder means being longitudinally extensible and retractable to pivot said sleeve about said trunnion means.

* * * * *